US009599923B2

(12) United States Patent
Kitamura et al.

(10) Patent No.: US 9,599,923 B2
(45) Date of Patent: Mar. 21, 2017

(54) IMAGE FORMING APPARATUS WITH CONTROL OF DEVELOPING BIAS AND CHARGING BIAS

(71) Applicant: CANON KABUSHIKI KAISHA, Tokyo (JP)

(72) Inventors: Takuya Kitamura, Yokohama (JP); Hideaki Hasegawa, Suntou-gun (JP); Shuichi Tetsuno, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/108,529

(22) Filed: Dec. 17, 2013

(65) Prior Publication Data

US 2014/0178086 A1 Jun. 26, 2014

(30) Foreign Application Priority Data

Dec. 21, 2012 (JP) ..... 2012-279047

(51) Int. Cl.
*G03G 15/043* (2006.01)
*G03G 15/00* (2006.01)

(52) U.S. Cl.
CPC ..... *G03G 15/043* (2013.01); *G03G 15/5008* (2013.01)

(58) Field of Classification Search
CPC ..... G03G 15/0266; G03G 15/0275; G03G 15/043; G03G 15/065; G03G 15/1675; G03G 21/04; G03G 21/08
USPC ..... 399/46, 50, 51, 55
See application file for complete search history.

(56) References Cited

U.S. PATENT DOCUMENTS 4,346,982 A * 8/1982 Nakajima et al. ..... 399/6
5,634,171 A * 5/1997 Muto ..... 399/32
5,678,130 A * 10/1997 Enomoto et al. ..... 399/55
5,740,502 A * 4/1998 Kobayashi et al. ..... 399/128
5,878,312 A * 3/1999 Hisada ..... 399/149
6,606,470 B1 * 8/2003 Wibbels et al. ..... 399/156
6,785,482 B2 * 8/2004 Ogata et al. ..... 399/55
(Continued)

FOREIGN PATENT DOCUMENTS

JP 2008-8991 A 1/2008

OTHER PUBLICATIONS

Shuichi Tetsuno Hideaki Hasegawa Takuya Kitamura, U.S. Appl. No. 14/100,452, filed Dec. 9, 2013.

*Primary Examiner* — David Gray
*Assistant Examiner* — Laura Roth
(74) *Attorney, Agent, or Firm* — Fitzpatrick, Cella, Harper & Scinto

(57) ABSTRACT

An image forming apparatus includes a photosensitive member; a charging device; an exposure device; and a developer carrying member, wherein, when it is assumed that an image forming area, a printing portion and a non-printing portion are an area on the photosensitive member on which an image to be transferred onto a recording material is formed, an area in the image forming area to which the developer adheres and an area in the image forming area to which the developer does not adhere, respectively, the exposure device exposes the printing portion at a first laser power, exposes the non-printing portion at a second laser power smaller than the first laser power, and exposes a non-image forming area on the photosensitive member between two adjacent image forming areas at no laser power or a third laser power smaller than the second laser power.

8 Claims, 9 Drawing Sheets

(56) References Cited

U.S. PATENT DOCUMENTS

| | | | | |
|---|---|---|---|---|
| 7,539,429 | B2 * | 5/2009 | Shimizu | 399/49 |
| 7,653,319 | B2 * | 1/2010 | Yamamoto et al. | 399/44 |
| 7,917,045 | B2 * | 3/2011 | Yagawara et al. | 399/38 |
| 8,275,276 | B2 * | 9/2012 | Fukuta | 399/50 |
| 2008/0170870 | A1 * | 7/2008 | Yamaguchi et al. | 399/49 |
| 2010/0111551 | A1 * | 5/2010 | Fujihara et al. | 399/55 |
| 2012/0230705 | A1 * | 9/2012 | Shimura et al. | 399/26 |
| 2012/0300009 | A1 * | 11/2012 | Toyoizumi et al. | 347/118 |
| 2013/0235142 | A1 * | 9/2013 | Katagiri | G03G 15/043 347/118 |

* cited by examiner

IMAGE FORMING APPARATUS WITH CONTROL OF DEVELOPING BIAS AND CHARGING BIAS

BACKGROUND OF THE INVENTION

Field of the Invention

The present invention relates to an image forming apparatus such as a copying machine or a printer using an electrophotographic printing method.

Description of the Related Art

Up to now, as a charging unit configured to charge an electrophotographic photosensitive member (hereinafter referred to as photosensitive member) serving as an image bearing member uniformly at a predetermined polarity and potential, a contact charging device is put into practical use for an image forming apparatus using an electrophotographic printing method because of having advantages such as low ozone and low power. Contact charging devices are of the type that charges a photosensitive member by applying a voltage to a charging member which is brought into contact with the photosensitive member. Contact charging devices which employ a roller charging method, where a charging roller (conductive roller) serves as a charging member, are particularly preferred in terms of charging stability, and are widely used.

The roller charging method is divided into an AC charging method, which applies a superimposed voltage generated from a direct current (DC) voltage and an alternating current (AC) voltage (oscillation voltage) to the charging roller as charging bias, and a DC charging method, which applies only a DC voltage as charging bias. The DC charging method is in use in recent years from the viewpoint of saving cost and space.

With the DC charging method, however, it is difficult to even out uneven potential of the photosensitive member after transfer (hereinafter referred to as transfer memory), and transfer memory is visible as an image in some cases.

Transfer memory is a phenomenon originating from unevenness in electric potential which is caused on the photosensitive member after the transfer of a toner image from the photosensitive member to a recording medium (recording material or secondary transfer member) by a difference in the amount of transfer current flowing to the photosensitive member surface between a portion where toner is present and a portion where toner is not present. The uneven potential on the photosensitive member cannot be evened out satisfactorily in a charging step of the subsequent image forming cycle, and is consequently visible on the formed image.

A conventional solution is optical residual charge elimination (whole surface erasure exposure) performed by a memory erasure unit in order to even out once the potential on the surface of the photosensitive member after transfer. However, providing a memory erasure unit causes an increase in the size and cost of the image forming apparatus.

As a way to reduce transfer memory without adding a memory erasure unit, background area exposure is known (see Japanese Patent Application Laid-Open No. 2008-8991). In background area exposure, an exposure unit exposes a printing portion on the photosensitive member where a toner image is formed to light after the photosensitive member is charged to a predetermined potential in the charging step, and concurrently exposes a non-printing portion where no toner image is formed to a small light intensity.

Photosensitive members, however, gradually succumb to light-induced fatigue by exposure. The decrease in the photosensitivity of the photosensitive member due to light-induced fatigue therefore needs to be taken into account in a unit which keeps the photosensitive member surface exposed to light as in Japanese Patent Application Laid-Open No. 2008-8991. With the advance in the prolonging of product life and the enhancement of image quality in recent years, as well as ever-greater user diversity, long-term stable performance is demanded of photosensitive members. In order to accomplish further prolonging of product life, it is important to reduce light-induced fatigue of the photosensitive member as much as possible and thereby reduce a decrease in sensitivity.

SUMMARY OF THE INVENTION

An object of the present application is therefore to reduce the light intensity at which a photosensitive member is exposed, while maintaining image quality, in an image forming apparatus of an electrophotographic printing method.

In order to achieve the above-mentioned object, according to an embodiment of the present invention, there is provided an image forming apparatus configured to form an image on a recording material, the image forming apparatus comprising:

a photosensitive member;

a charging device configured to charge the photosensitive member by a charging bias being applied to the charging device;

an exposure device configured to expose the photosensitive member which has been charged by the charging device to light to form a latent image on the photosensitive member; and a developer carrying member which carries a developer and which is configured to develop the latent image with the developer by a developing bias being applied to the developer carrying member, wherein, when it is assumed that an image forming area, a printing portion and a non-printing portion are an area on the photosensitive member on which an image to be transferred onto a recording material is formed, an area in the image forming area to which the developer carrying member makes the developer adhere and an area in the image forming area to which the developer carrying member does not make the developer adhere, respectively, the exposure device exposes the printing portion in the image forming area at a first laser power, exposes the non-printing portion in the image forming area at a second laser power smaller than the first laser power, and exposes a non-image forming area on the photosensitive member between two adjacent image forming areas at no laser power or a third laser power smaller than the second laser power.

Further features of the present invention will become apparent from the following description of exemplary embodiments with reference to the attached drawings.

DESCRIPTION OF THE EMBODIMENTS

First Embodiment

Embodiments of the present invention will be described in detail below with reference to the accompanying drawings.

<Description of the Configuration of an Image Forming Apparatus Example>

Figure 1:
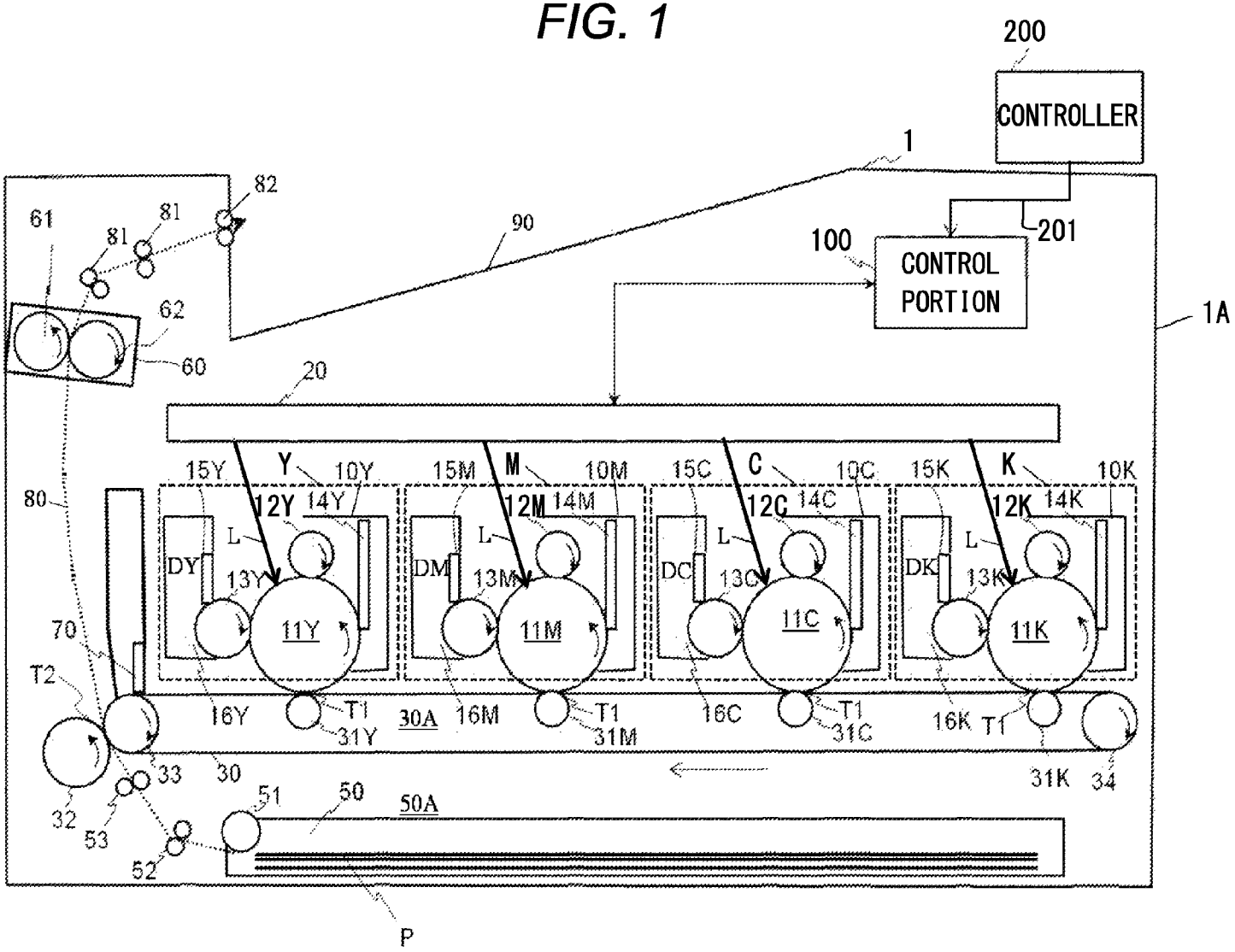
FIG. 1 is a schematic sectional view of a color image forming apparatus according to a first embodiment.

FIG. 1 is a schematic configuration diagram of an image forming apparatus 1 according to a first embodiment. The image forming apparatus 1 is an electrophotographic color laser beam printer of an intermediate transfer method which has four image forming stations, Y, M, C, and K. Specifically, a printer controller 200 connected to a printer control portion 100 via an interface 201 inputs image data (electrical image information), a color image corresponding to the image data is formed by an electrophotographic printing method on a recording material P which is a recording medium, and the printed material on which the image has been formed is output.

The printer control portion 100 is a control unit (control portion) configured to control an image forming process of the image forming apparatus 1, and exchanges various electrical information signals with the printer controller 200, which is an external host unit. The printer control portion 100 also handles processing of electrical information signals which are input from various process devices and sensors, processing of command signals which are commands to the various process devices, control of a predetermined initial sequence, and control of a predetermined image forming sequence. The printer controller 200 is a host computer, a network, an image reader, a facsimile, or the like.

The four image forming stations, Y, M, C, and K are each an electrophotographic image forming portion, and are arranged at regular intervals side by side laterally (in a substantially horizontal direction) from the left to the right in the interior of the image forming apparatus 1 in FIG. 1, thereby constituting what is called a tandem type. These electrophotographic image forming portions respectively have process cartridges 10 (10Y, 10M, 10C, and 10K) as their main portions which are detachably attached to mounting portions of an apparatus main body 1A of the image forming apparatus 1 by a predetermined procedure.

The process cartridges (hereinafter referred to as cartridges) 10 have the substantially same electrophotographic image forming mechanism, except that the color of contained developer (toner) differs from one cartridge to another. Each cartridge 10 in the embodiment has a rotary drum-type electrophotographic photosensitive member (hereinafter referred to as drum) 11 (11Y, 11M, 11C, or 11K) as a first image bearing member. Each cartridge 10 also has, as a process unit which works on the drum 11, a charging unit (charging device) 12 (12Y, 12M, 12C, 12K), a developing unit D (DY, DM, DC, DK), and a cleaning unit 14 (14Y, 14M, 14C, 14K).

The charging unit 12 charges the surface of the drum 11 uniformly at a predetermined potential. The charging unit 12 in the embodiment is a charging roller (roller charging device) serving as a contact charging member.

The developing unit D visualizes (develops), with the use of developer, an electrostatic latent image formed on the drum 11. The developing unit D in the embodiment is a reverse developing device of a one-component contact developing method. The developing device D has a developing roller 13 (13Y, 13M, 13C, 13K) configured to carry and convey non-magnetic, one-component, toner (negative charge characteristics: negative toner) as developer. The developing roller 13 is a developer carrying member on which developer is carried, and is opposed to the drum 11. In the embodiment, the developing roller 13 and the drum 11 come into contact with each other.

The developing unit D also has a developing blade (15Y, 15M, 15C, 15K) configured to level a toner layer on the developing roller 13. The developing unit D has a developer container 16 (16Y, 16M, 16C, 16K) configured to contain developer.

The developer container 16Y of the cartridge 10Y contains yellow (Y) toner as developer. The developer container 16M of the cartridge 10M contains magenta (M) toner as developer. The developer container 16C of the cartridge 10C contains cyan (C) toner as developer. The developer container 16K of the cartridge 10K contains black (K) toner as developer.

The cleaning unit 14 is a drum cleaner configured to clean the surface of the drum 11 after a toner image is transferred and, in the embodiment, is a blade cleaner which uses a blade as a cleaning member.

The drum 11 is driven by a driving unit (not shown) in the apparatus main body 1A to rotate counterclockwise, the direction indicated by the arrow, at a surface movement speed (process speed) of, in the embodiment, 120 mm/sec. The drum 11 is constructed by forming a charge generation layer and a charge transport layer applied in the form of a thin film on an aluminum cylinder which has an external diameter of 30 mm and which serves as a base material. The aluminum cylinder is grounded.

The charging roller 12 has a core metal and a conductive elastic substance layer, which is formed around the core metal concentrically and integrally with the core metal. The charging roller 12 is arranged substantially parallel to the drum 11, and is pressed against the drum 11 at a predetermined pressing force which counters the elasticity of the conductive elastic substance layer. The core metal is rotatably supported at each end by a bearing. The charging roller 12 rotates following the rotation of the drum 11. In the embodiment, a power supply portion (not shown) in the apparatus main body 1A applies a DC voltage of approximately −1000 V as charging bias voltage to the core metal of the charging roller 12 (DC charging method).

The developing roller 13 has a core metal and a conductive elastic substance layer, which is formed around the core metal concentrically and integrally with the core metal. The developing roller 13 is arranged substantially parallel to the drum 11, and is driven by the driving unit (not shown) in the apparatus main body 1A to rotate clockwise, the direction indicated by the arrow, at a predetermined surface movement speed. The developing blade is constructed from a thin metal plate made of SUS (stainless steel in Japan Industrial Standards: JIS), and is pressed against the developing roller 13 at its free end at a predetermined pressing force. The developing roller 13 carries and conveys toner charged to negative potential by friction to a developing position, which faces the drum 11.

The developing device D is configured so that the developing roller 13 is brought into contact with the drum 11 and moved away from the drum 11 by a contact-separation mechanism (not shown). In an image forming step, the developing roller 13 of the developing device D is pressed against the drum 11, and the power supply portion (not shown) in the apparatus main body 1A applies a DC voltage of approximately −300 V as a developing bias voltage to the core metal of the developing roller 13.

A laser exposure unit 20 is provided above the four image forming stations, Y, M, C, and K, within the apparatus main body 1A as an exposure unit (exposure device) configured to expose the drums 11 of the respective cartridges 10 to light. A time-series electric digital pixel signal of image information, which is input from the printer controller 200 to the control portion 100 via the interface 201 to be subjected to image processing, is input to the laser exposure unit 20.

The laser exposure unit 20 includes a laser output portion configured to output laser light modulated according to the input time-series electric digital pixel signal, a rotary polygonal mirror (polygon mirror), an fθ lens, and a reflecting mirror. The laser exposure unit 20 uses laser light L to perform main scanning exposure (digital exposure) on the charged surface of the drum 11. An electrostatic latent image corresponding to the image information is formed on the surface of the drum 11 by the main scanning exposure and sub scanning due to rotation of the drum 11. Then, the electrostatic latent image is developed by the developing device D.

Specifically, a Y-color toner image which corresponds to a Y-color component image of a full-color image is formed on the surface of the drum 11Y in the cartridge 10Y at a predetermined control timing. An M-color toner image which corresponds to an M-color component image of the full-color image is formed on the surface of the drum 11M in the cartridge 10M at a predetermined control timing. A C-color toner image which corresponds to a C-color component image of the full-color image is formed on the surface of the drum 11C in the cartridge 10C at a predetermined control timing. A K-color toner image which corresponds to a K-color component image of the full-color image is formed on the surface of the drum 11K in the cartridge 10K at a predetermined control timing.

An intermediate transfer belt unit 30A is provided below the image forming stations Y, M, C, and K within the apparatus main body 1A. The unit 30A includes a secondary transfer counter roller 33 and a drive roller 34, which are disposed on the left side and the right side of the apparatus main body 1A in FIG. 1, respectively, and an intermediate transfer belt (secondary transfer member: hereinafter referred to as belt) 30 as a second image bearing member, which is passed over the rollers 33 and 34.

The belt 30 is a resin film shaped so as to have no ends. The resin film is a film having an electric resistance (volume resistivity) of approximately $10^{11}$ to $10^{16}$ Ω·cm and a thickness of 100 to 200 μm, and made of PVDF (polyvinylidene fluoride), nylon, PET (polyethylene terephthalate), PC (polycarbonate), or the like. The belt is circulatingly driven clockwise, in the direction indicated by the arrow, at a predetermined process speed (a speed substantially equivalent to the surface movement speed of the drums 11) when the drive roller 34 is driven and rotated by a motor (not shown) clockwise, the direction indicated by the arrow.

Four primary transfer rollers 31 (31Y, 31M, 31C, and 31K) which are associated with the respective drums 11 of the cartridges 10 are provided inside the belt 30. The primary transfer rollers 31 are each shaped like a roller in which a conductive elastic layer is provided around a shaft, are placed substantially parallel to their associated drums 11, and are pressed against the bottom portion of the surfaces of the drums 11 through the ascending side belt portion of the belt 30 at a predetermined pressing force. A contact portion between the belt 30 and the drum 11 in each of the image forming stations Y, M, C, and K is a primary transfer position (primary transfer nip portion) T1.

The power supply portion (not shown) applies a positive DC voltage (a predetermined primary transfer bias voltage) to the shaft of each primary transfer roller 31, thereby forming a primary transfer electric field.

A secondary transfer roller 32 is opposed to the secondary transfer counter roller 33 through the belt 30, and is held with a suitable pressure applied to the secondary transfer roller 32. A contact portion between the secondary transfer roller 32 and the belt 30 is a secondary transfer position (secondary transfer nip portion) T2. The power supply portion (not shown) applies a positive DC voltage (a predetermined secondary transfer bias voltage) to the secondary transfer roller 32, thereby forming a secondary transfer electric field. In a portion of the secondary transfer counter roller 33 around which the belt wraps, a belt cleaner 70 is disposed at a point next to the secondary transfer position T2 (downstream of the secondary transfer position T2 in the rotation direction of the belt).

A sheet feeding unit 50A is provided below the intermediate transfer belt unit 30A. The sheet feeding unit 50A includes a cassette 50 configured to contain the recording material (transfer material) P, which is the final recording medium. The sheet feeding unit 50A also includes a pickup roller 51 configured to send one sheet of the recording material P at a time out of the cassette 50, a sheet feeding roller pair 52 configured to convey the recording material P sent out by the pickup roller 51, a registration roller pair 53 configured to control the timing of sending the recording material P to the secondary transfer position T2, and others.

An upward conveyance path 80 of the recording material P which begins at the pickup roller 51 of the sheet feeding unit 50A and leads to a sheet discharge tray (sheet discharge portion) 90 on the top of the image forming apparatus is provided on the left side within the apparatus main body 1A. Disposed along the conveyance path from the upstream to downstream of the recording material conveying direction are the sheet feeding roller pair 52, the registration roller pair 53, the secondary transfer roller 32, a fixing unit 60, and a sheet discharge roller pair 82. A guide plate (not shown) configured to guide the recording material P which is being conveyed and relay conveyance roller pairs 81 are also disposed along the conveyance path 80.

The fixing unit 60 includes a fixing roller 62, which is heated by a fixing heater, and a pressure roller 61, which is pressed against the fixing roller 62 at a predetermined pressing force.

Receiving a print signal, the control portion 100 starts the operation of the respective drums 11 of the cartridges 10, the belt 30, and other rotating drive portions to start image forming operation.

After the drums 11 start rotating, a charging bias is applied to the charging rollers 12 to charge the drums 11 uniformly throughout the drum surface. The charged surface of each drum 11 reaches an exposure position, and then a laser element within the laser exposure unit 20 is lit in accordance with image information to expose the drum surface to laser light L for main scanning exposure. An electrostatic latent image which corresponds to the pattern of main scanning exposure is formed on the surface of each drum 11 in this manner.

The electrostatic latent image formed on the drum surface is developed with toner on the developing roller 13, which is in contact with the drum 11 and thus rotating, to be visualized. The visualized toner image is transferred at the primary transfer position T1 onto the intermediate transfer belt 30, due to a potential difference between the positive voltage applied to the primary transfer roller 31 and the potential of the surface of the drum 11.

When a color image is to be formed, these steps are executed sequentially in the four image forming stations, Y, M, C, and K, to form, by transfer, superimposed toner images of multiple colors on the belt 30. In the embodiment, a Y-color toner image, an M-color toner image, a C-color toner image, and a K-color toner image which are formed in the image forming stations Y, M, C, and K on their respective drums 11 are superimposed on the belt in a predetermined manner, to form unfixed composite color toner images.

The toner images formed on the belt 30 undergo secondary transfer at the secondary transfer position T2, where the toner images are transferred at once onto the recording material P conveyed at predetermined timing from the sheet feeding unit 50A by the secondary transfer roller 32 to which a positive voltage is applied.

The toner images transferred onto the recording material P are fixed on the recording material P as a fixed image in the fixing unit 60 upon the melting of toner which takes place when the recording material P passes (a fixing nip portion) between the fixing roller 62 heated to a predetermined temperature and a pressure roller 61 pressing at a predetermined pressure. The recording material P is then conveyed and discharged to the sheet discharge tray 90 as an image-printed material.

Steps of cleaning untransferred toner off on the drums 11 and the belt 30 are executed in parallel to the steps described above. Specifically, toner which has not been transferred at the primary transfer position T1 and remains on the respective drums 11 of the image forming stations Y, M, C, and K is scraped off by the blade members of the drum cleaners 14 and collected in a cleaner container. Toner which has not been transferred onto the recording material P at the secondary transfer position T2 and remains on the belt 30 is scraped off by a blade member of the belt cleaner 70 and collected in the cleaner container.

Figure 2A:
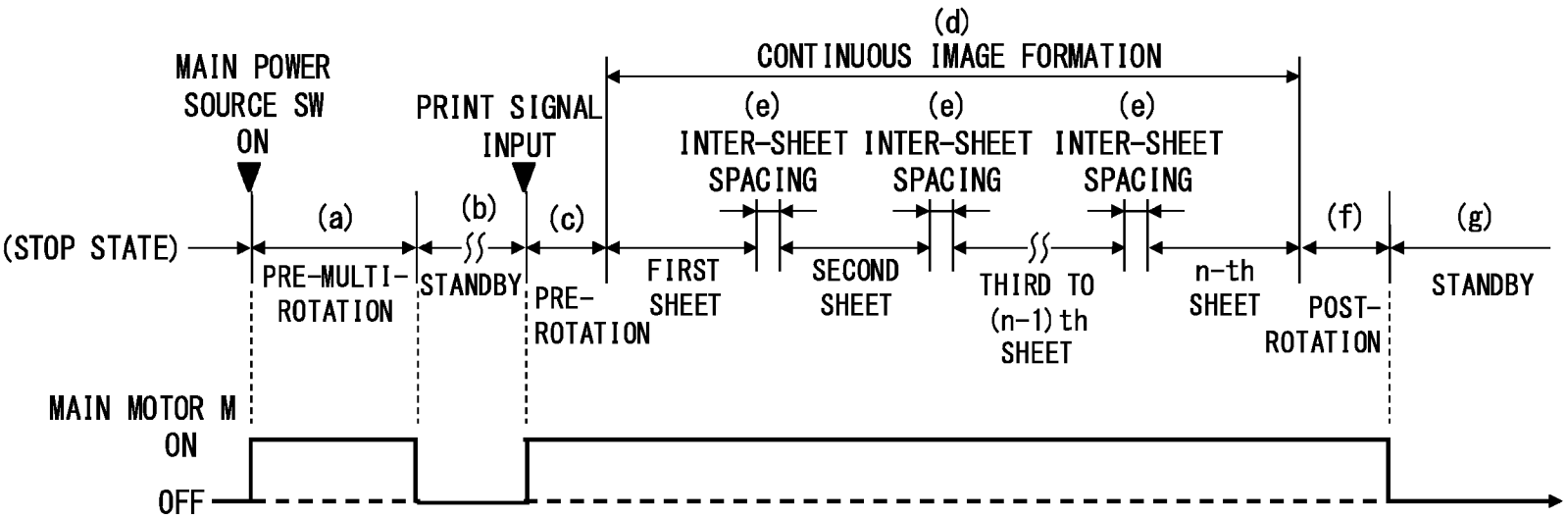
FIG. 2A is an operation chart of the image forming apparatus.

FIG. 2A is an operation chart of the image forming apparatus 1 which illustrates an image forming process (printing process) executed by the control portion 100.

(a) Pre-Multi-Rotation Operation

Pre-multi-rotation operation is an apparatus start-up operation step (warming operation step) which is executed when a main power source SW of the image forming apparatus 1 is turned on. In this step, a main motor M is started up to drive and rotate the drums 11, and predetermined process devices execute predetermined start-up operations.

(b) Standby

Standby is a state in which the main motor M is stopped after the completion of the predetermined pre-multi-rotation operation to wait for the input of a print signal (image signal: image formation execution request) to the control portion 100 from the printer controller 200.

(c) Pre-Rotation Operation

Pre-rotation operation is a before-image formation operation step which is executed when a print signal is input from the printer controller 200 to the control portion 100. In this step, the main motor M is driven to drive and rotate the drums 11, and predetermined process devices execute predetermined before-image formation operations. This pre-rotation operation is executed in succession to the pre-multi-rotation operation in the case where a print signal is input during the pre-multi-rotation operation.

(d) Image Forming Operation

Image forming operation is an image forming operation step of forming on the recording material P an image which corresponds to image information input to the control portion 100 from the printer controller 200. The image forming operation is executed following the completion of the predetermined pre-rotation operation. In the case of a continuous image formation mode, the image forming operation for one sheet of the recording material P is executed repeatedly as many times as a set number of sheets on which the image is to be formed.

(e) Inter-Sheet Spacing

This step is in a state of an interval between the image forming operation for one sheet of recording material and the image forming operation for the next sheet of recording material in the continuous image formation mode.

(f) Post-Rotation Operation

Post-rotation operation is an after operation step which is executed after the image forming operation is completed for one sheet of recording material or a set number of sheets of recording material. The main motor M is kept driven for a predetermined length of time even after the completion of the image forming operation to allow predetermined process devices to execute predetermined finishing operations.

(g) Standby

Standby is a state in which the main motor M is stopped after the completion of the predetermined post-rotation operation to wait for the input of a next print signal to the control portion 100 from the printer controller 200. When the next print signal is input, the operation cycle described above which includes the pre-rotation operation, the image forming operation, and the post-rotation operation is executed again.

Of the operation steps described above, the pre-multi-rotation operation, the pre-rotation operation, the inter-sheet spacing in continuous image forming operation, and the post-rotation operation are periods in which no image is being formed on the drums 11. A drum surface area relevant to these non-image forming periods is a non-image forming area. A period in which an image to be printed on the recording material P is being formed on the drum surface is an image-forming period. A drum surface area relevant to the image forming period is an image forming area.

Figure 2B:
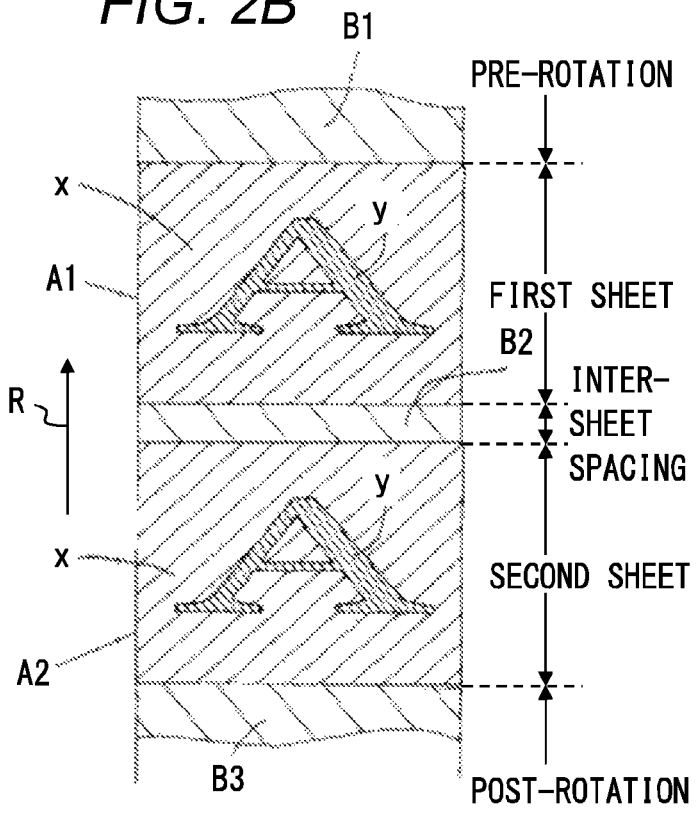
FIG. 2B is a schematic diagram illustrating a printing portion and non-printing portion of an image forming area and a non-image forming area on a drum surface.

FIG. 2B is a schematic diagram illustrating a printing portion and non-printing portion of an image forming area on the drum surface and a non-image forming area on the drum surface in the operation steps of the image forming apparatus 1 described above. FIG. 2B is a net diagram in a rotation direction (surface movement direction) R of the drum surface.

FIG. 2B illustrates a case of forming images on two sheets of recording material which are fed in succession.

An image forming area A1 and an image forming area A2 correspond to the first sheet of recording material and the second sheet of recording material, respectively. The image forming areas A1 and A2 each have a printing portion (exposure portion) y and a non-printing portion (non-exposure portion) x. In the image forming apparatus 1 of the embodiment, a toner image is formed when toner adheres to the printing portion y which is an exposure portion by a reversal phenomenon.

An area B1 is a non-image forming area which is relevant to the pre-rotation operation period. An area B2 is a non-image forming area which is relevant to the period of inter-sheet spacing between the first sheet and second sheet of recording material (a non-image forming area intervening between the two adjacent image forming areas A1 and A2). An area B3 is a non-image forming area which is relevant to the post-rotation operation period.

<Exposure Control of Image Forming Areas>

Exposure control of the embodiment deals with the following two main problems.

(1) Drum Ghost

A potential difference may be generated between an exposed portion and unexposed portion of one drum 11 when the drum 11 is charged in the next charging step. The potential difference leads to a drum ghost image in some cases. Charges remaining in the charge transport layer of the portion exposed to light in the previous step, or other factors, cause a potential difference between the exposed portion and the unexposed portion in the next charging step.

Figure 3:
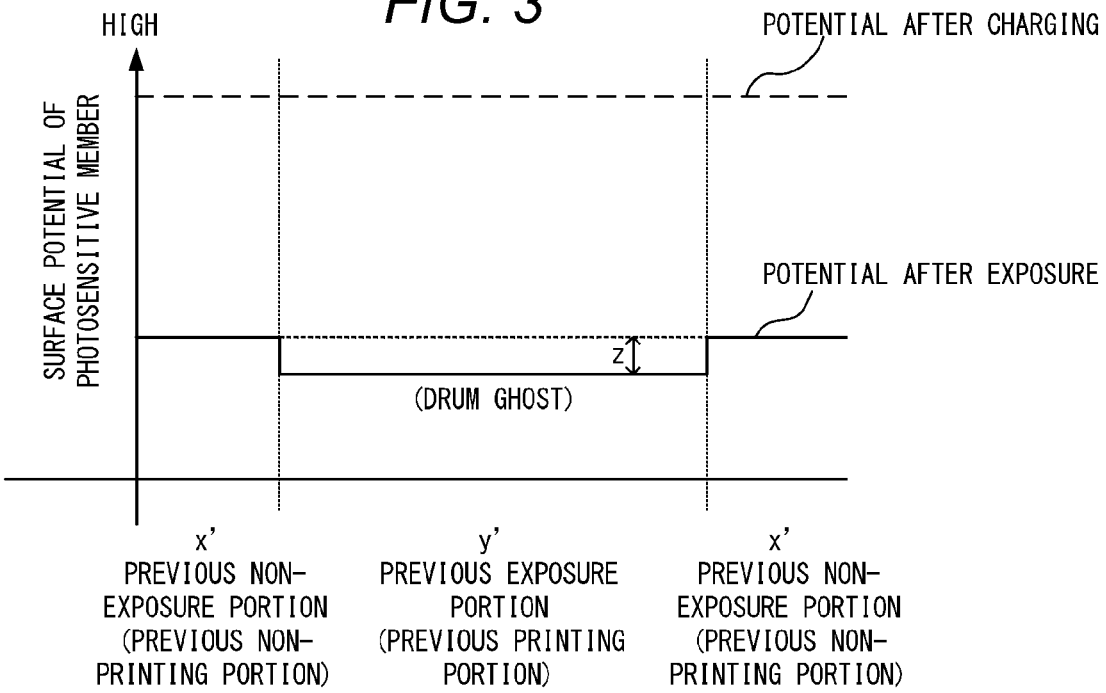
FIG. 3 is a sensitivity graph of a photosensitive drum.

Consequently, when the drum 11 is exposed to light again in the exposure step, there is a difference in post-exposure potential (z in FIG. 3) between the portion which has been exposed to light in the previous step (a last printing portion y') and the portion which has not been exposed to light in the previous step (a last non-printing portion x') as shown in FIG. 3. In other words, a potential difference between the last printing portion y' where an image has been printed in the immediately preceding image-forming period and the last non-printing portion x' where no image has been printed in the immediately preceding image-forming period remains on the drum 11 even in the next image-forming period. If this potential difference is large, a density difference (drum ghost) appears on the ultimately formed image.

This phenomenon is controlled by performing background area exposure control in which the non-printing portions x of FIG. 2B are also irradiated with laser light in the exposure step. With the printing portions y and the non-printing portion x both exposed to light, there is little chance for a potential difference and the density difference can be accordingly reduced.

An effective countermeasure for drum ghost is to expose the areas of the printing portions y to a light intensity of approximately 0.015 $\mu J/cm^2$ or more. Exposing the charged drum 11 to a light intensity of 0.015 $\mu J/cm^2$ causes the potential of the drum 11 to drop by about 20 V compared to the drum potential prior to the exposure. The light intensity (laser power L1) received by the printing portions y on the surface of the drum 11 is 0.320 $\mu J/cm^2$ in the embodiment. Other areas than the printing portions (the non-printing portions x of the image forming areas and the non-image forming areas B1 to B3) are therefore exposed to a light intensity smaller than 0.320 $\mu J/cm^2$ and equal to or more than 0.015 $\mu J/cm^2$.

Though details will be described later, the light intensity to which the non-printing portions x of the image forming areas A1 and A2 are exposed is set to 0.055 $\mu J/cm^2$ and the light intensity to which the non-image forming areas B1 to B3 are exposed is set to 0.015 $\mu J/cm^2$ in the embodiment.

(2) Transfer Memory

When a color image is printed, a toner image is formed on the belt 30 in an upstream station in the moving direction of the belt 30 out of the four image forming stations, Y, M, C, and K, which are arranged in tandem, and the potential of the drum 11 in a downstream station is distorted due to the toner image, which could result in a defective image (transfer memory). This phenomenon will be described below in detail.

To output a desired color on a printed material, toner of one color and toner of another color are overlaid on each other, for example, Y-color toner and M-color toner in the case of a color red, M-color toner and C-color toner in the case of a color blue, and Y-color toner and C-color toner in the case of a color green. These images are created in the yellow image forming station 10Y, the magenta image forming station 10M, and the cyan image forming station 10C which are upstream of the black image forming station 10K. A Y-color toner image, an M-color toner image, and a C-color toner image are therefore already present on the belt 30 at the time an image is formed in the black image forming station 10K. When toner of another color is on the belt 30, particularly when there is a large stack of toner layers of multiple colors (hereinafter referred to as multiple color portion), the amount of transfer current which flows from the transfer roller 31 into the drum 11 via the belt 30 is very small. The difference in the amount of current flow between a multiple color portion on the belt 30 and a portion of the drum 11 where toner is not present therefore leads to a large difference in the potential of the photosensitive drum surface past the primary transfer position T1.

Figure 4A:
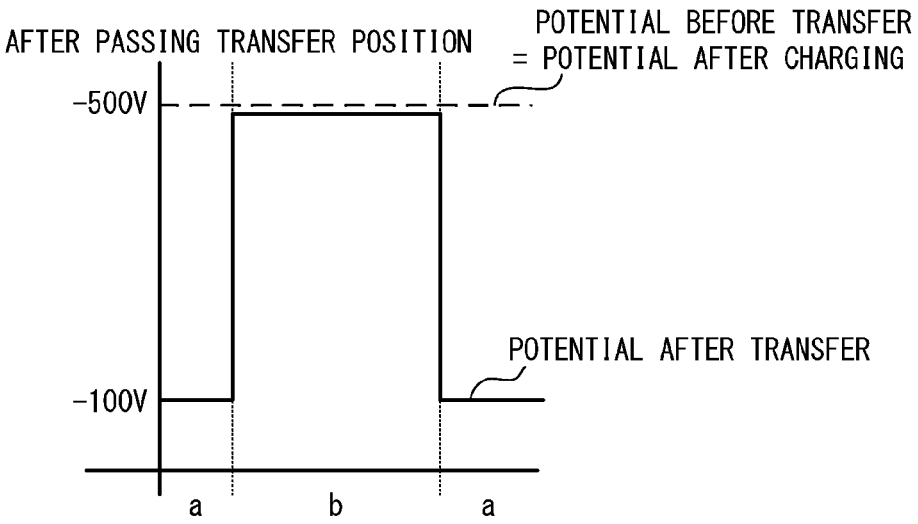
FIGS. 4A, 4B, and 4C are explanatory diagrams of multicolor toner transfer memory.
Figure 4B:
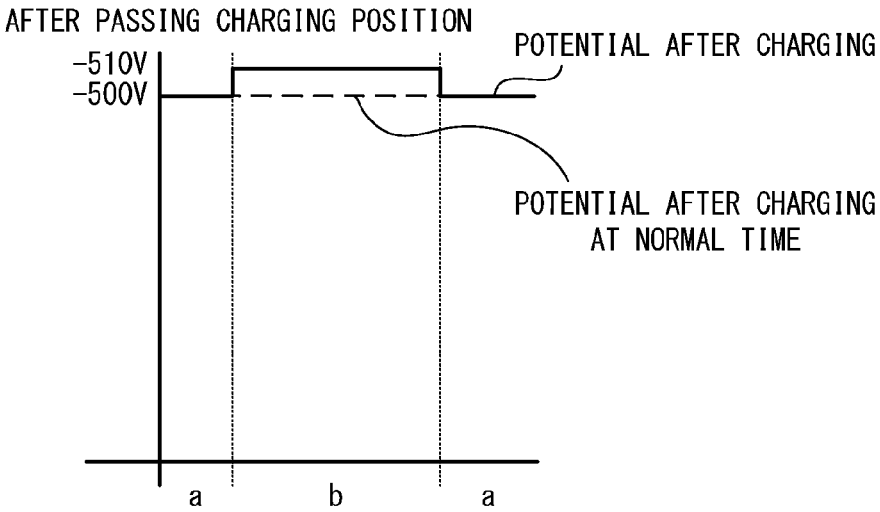
Figure 4C:
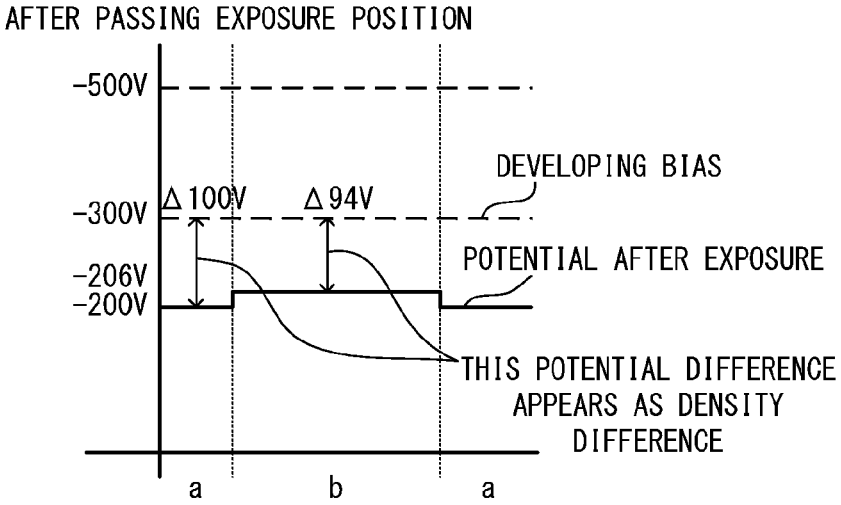

FIGS. 4A, 4B, and 4C show the potential of the surface of the drum 11 in the black image forming station 10K. In FIGS. 4A to 4C, portions "a" show a drum surface potential corresponding to a portion of the belt 30 where toner is not present and portions "b" show a drum surface potential corresponding to a multiple color portion on the belt 30.

The potential shown in FIG. 4A is one observed past the primary transfer position T1. The potential in the portion "a" has changed to approximately −100 V from the potential prior to the passing of the primary transfer position T1. The potential in the portion "b", on the other hand, has changed slightly but not significantly from the potential prior to the passing of the primary transfer position T1. Executing the charging step in this state causes the potential of the portion "b" to be higher than that of the portion "a" by about 10 V as shown in FIG. 4B.

When a whole surface exposure is performed next in the exposure step in order to achieve a halftone density, a slight improvement is observed but a potential difference of approximately 6 V still remains as shown in FIG. 4C. Executing the development step in this state where there is a potential difference causes a difference in the amount of toner transferred from the developing roller 13 to the drum which is in proportion to the potential difference. This difference in toner amount ultimately appears on the resultant image as a density difference in which the density is lower in the portion "b" than in the portion "a". The cause thereof has been found out to be, according to a study conducted by the inventors of the present invention, uneven potential after charging due to the potential difference generated after transfer. This phenomenon occurs particularly frequently in DC charging.

Figure 5:
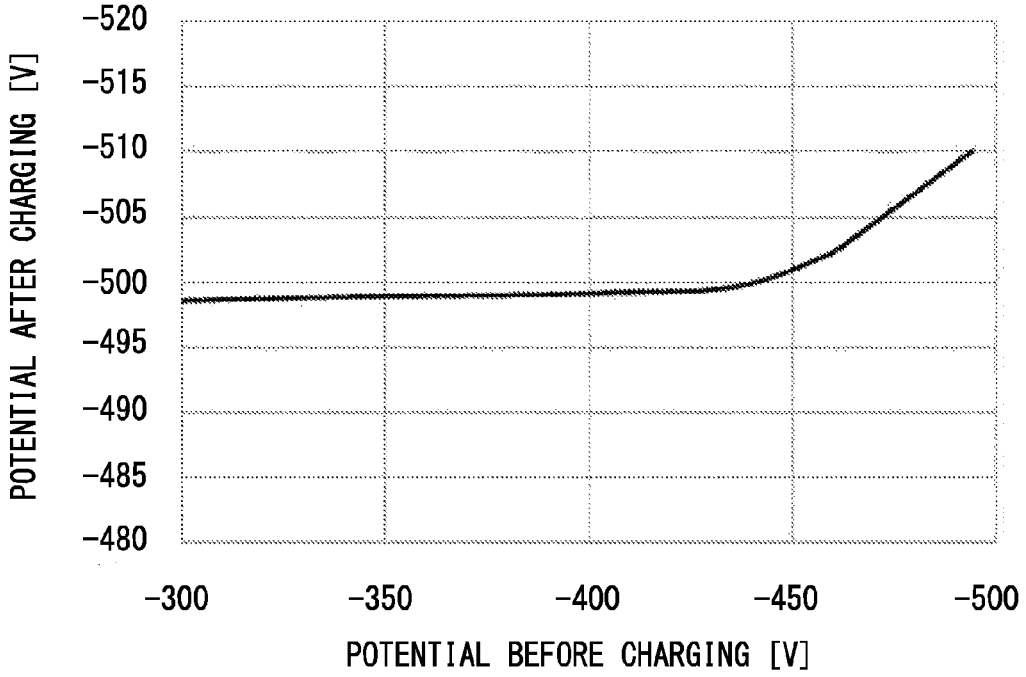
FIG. 5 is a graph showing a relation between photosensitive drum potential before charging and photosensitive drum potential after charging.

FIG. 5 is a graph showing a relation between the potential of the surface of the drum 11 prior to charging and drum surface potential after charging which has been obtained through a study by the inventors of the present invention. In the experiment, the surface potential of the drum 11 has been measured by applying a charging bias voltage of −1,050 V in an environment where the temperature is 25 Celsius degrees and the relative humidity is 50%.

FIG. 5 shows that the potential after charging is unstable when the potential prior to charging is close to the potential after charging. The potential after charging is relatively stable around −498 V to −500 V when the absolute value of the potential prior to charging is equal to or less than the absolute value of approximately −440 V. When the absolute value of the before-charging potential exceeds the absolute value of −440 V, on the other hand, a potential having an absolute value exceeding the absolute value of −500 V which is a target after-charging potential gradually begins to register. In other words, the after-charging potential is stable when a difference between the target after-charging potential and the before-charging potential is approximately 60 V or more, and the absolute value of the after-charging potential gradually takes a higher value when the difference is smaller than 60 V. This phenomenon in which a potential larger than the target after-charging potential is registered is referred to as "over-charging".

As described above, the cause of multicolor toner transfer memory (FIGS. 4A to 4C) is a difference in after-charging potential due to the over-charging phenomenon which results from the before-charging potential maintaining substantially the same potential as the after-charging potential in a portion of the photosensitive drum surface where toner is present.

Figure 6A:
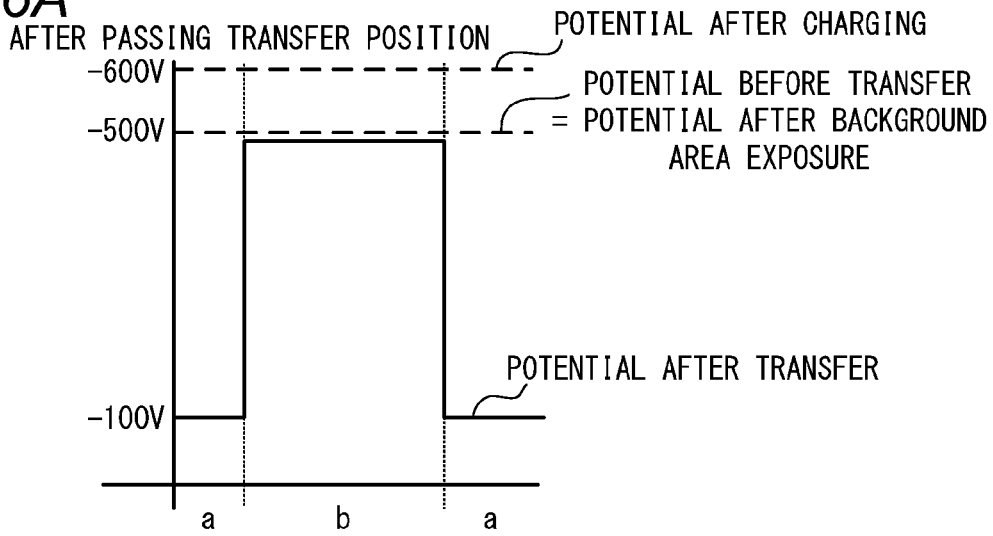
FIGS. 6A, 6B, and 6C are graphs showing transitions of photosensitive drum potential which are observed when background area exposure is executed.
Figure 6B:
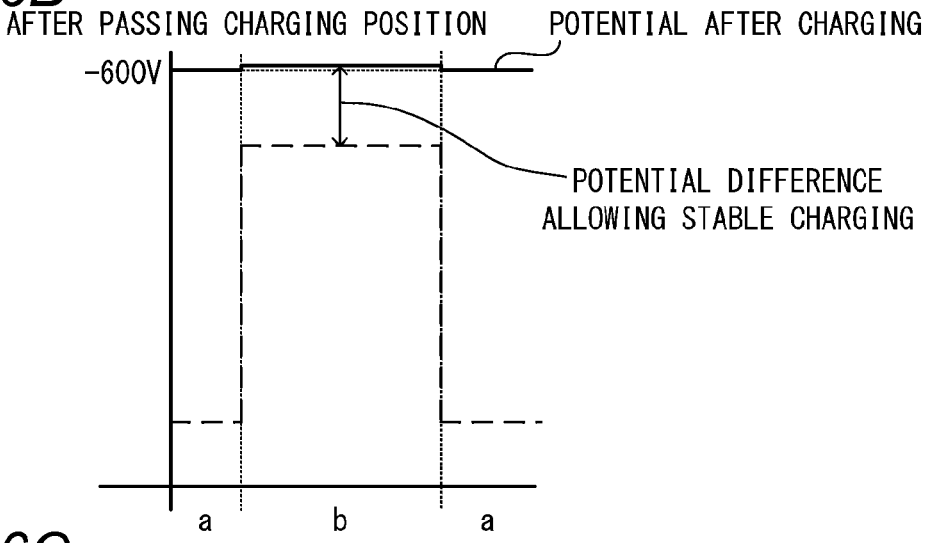
Figure 6C:
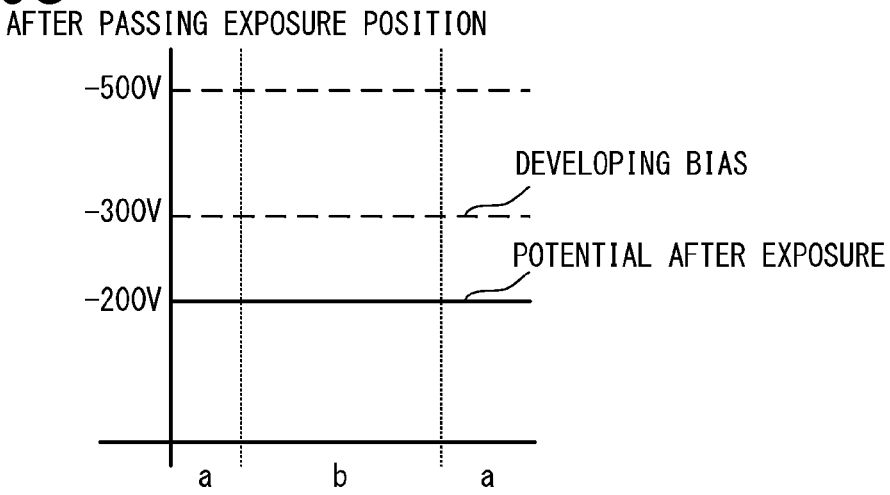

The inventors of the present invention have found out that the background area exposure control described above is effective also as a measure for reducing multicolor toner transfer memory. The mechanism of the reduction of multicolor toner transfer memory by background area exposure control will be described next. FIGS. 6A, 6B, and 6C show, similarly to FIGS. 4A, 4B, and 4C, the potential of the surface of the drum 11 in the black image forming station 10K.

As shown in FIG. 6A, the drum 11 charged to approximately −600 V is exposed through the exposure step in the portion "b" to a light intensity slightly larger than the light intensity at which non-printing portions are irradiated in order to reduce drum ghost. The absolute value of the photosensitive drum surface potential thus drops to the absolute value of approximately −500 V by the time the primary transfer position T1 is reached. The light intensity (laser power) received by the surface of the drum 11 at this point is 0.055 $\mu J/cm^2$.

The potential after the primary transfer position T1 is passed is substantially the same as in FIG. 4A, and there is a large difference in potential between the portion "a" and the portion "b". FIG. 6B shows the potential observed past the charging position. Though there is a potential difference between the portion "a" and the portion "b" prior to charging, the potential difference from a target charging potential is large enough in the portion "b" as well. The drum 11 can therefore be charged uniformly and the charging potential is substantially even throughout the drum surface.

As a matter of course, as shown in FIG. 6C, the potential remains even after exposure for achieving a halftone density is performed in the exposure step, and no density difference appears on the final image as well.

Stable charging is accomplished when there is a difference of approximately 60 V or more between the target after-charging potential and the before-charging potential as shown in FIG. 5. The background area exposure therefore reduces the absolute value of the potential after charging by about 100 V in the embodiment. This ensures that the difference between the target charging potential and the before-charging potential is always 100 V or more, and thus keeps the after-charging potential at the target charging potential.

<Problems in Background Area Exposure>

However, background area exposure which is executed to reduce multicolor toner transfer memory requires the laser to emit light so as to constantly change the potential by about 100 V. This means that the drum 11 is kept irradiated with a rather large amount of laser light, and can cause light-induced fatigue in the charge transport layer of the drum 11 and the underlying charge generation layer, which is problematic particularly when the prolonging of product life is aimed for. The drum 11 which suffers from light-induced fatigue is decreased in sensitivity, and may consequently bring about the phenomenon in which the density decreases through a failure to secure a necessary potential difference between developing bias and the potential of a printing portion on the drum 11 (hereinafter referred to as development contrast).

Another obstacle to prolonging the life of the apparatus main body 1A of the image forming apparatus 1 is a phenomenon in which the light emission period extended by performing background area exposure deteriorates the laser element and accordingly reduces the light intensity emitted. Also in this case, a satisfactory development contrast cannot be secured and the density decreases as a result.

Moreover, the surface potential of the drum 11 needs to be set to a value greater on the negative side than the target charging potential once in order to execute background area exposure. This requires a larger amount of discharge than normal at the time of charging, and the increased discharge damages the surface of the drum 11 to a point that the drum surface is susceptible to chipping.

<Background Area Exposure Control>

A feature of the present invention will be described which is a method of reducing the light intensity received by the surface of the drum 11 as much as possible in order to deal with the problems in background area exposure control with regard to the prolonging of product life.

As described above, only the non-printing portions x of the image forming areas A1 and A2 require background area exposure to a large light intensity which is executed to reduce transfer memory, whereas the non-image forming areas B1 to B3 do not need this background area exposure. The non-image forming areas B1 to B3 here refer to the drum surface areas illustrated in FIG. 2B. The areas B1 to B3 are specifically defined as follows.

1) The drum surface area B2 corresponds to an interval (inter-sheet spacing) between one sheet of recording material P and another sheet of recording material P in the printing process.

2) The drum surface area B1 corresponds to a period of a preparation operation (a pre-rotation step) before the printing process is started.

3) The drum surface area B3 corresponds to a period of an operation (a post-rotation step) after the printing process is completed.

Background area exposure to a light intensity smaller than the light intensity of background area exposure for the non-printing portions x of the image forming areas A1 and A2 is sufficient for the non-image forming areas B1 to B3 which are free of transfer memory. The light intensity of exposure can therefore be reduced in the areas B1 to B3.

Specifically, the light intensity is changed over among three situations, which are the exposure of the printing portion y in the image forming area, the exposure of the non-printing portion x in the image forming area, and the exposure of the non-image forming areas B1 to B3.

The light intensity (first laser power L1) used for the printing portions y of the image forming areas is set to 0.320 $\mu J/cm^2$ in the embodiment. The light intensity (second laser power L2) used for the non-printing portions x of the image forming areas is set to 0.055 $\mu J/cm^2$. The light intensity (third laser power L3) used for the non-image forming areas B1 to B3 is set to 0.015 $\mu J/cm^2$. In short, the first laser power, the second laser power, and the third laser power satisfy a relation L1>L2>L3.

Varying the intensity (brightness) of light is one way to make the second laser power L2 for the exposure of the non-printing portions x smaller than the first laser power L1 for the exposure of the printing portions y. Specifically, light to which the non-printing portions x are exposed is made less intense (darker) than light to which the printing portions y are exposed.

Another way is to vary the length of time of exposure to light between the printing portions y and the non-printing portions x. Specifically, the non-printing portions x are exposed to light for a shorter time than the exposure time of the printing portions y while the brightness of light is fixed for the exposure of the printing portions y and the exposure of the non-printing portions x. This method also makes the second laser power L2 for the exposure of the non-printing portions x smaller than the first laser power L1 for the exposure of the printing portions y. Furthermore, the non-image forming areas B1 to B3 in this case is exposed to light for an even shorter time than the exposure time of the non-printing portions x.

<Problems in Background Area Exposure Control>

Figure 7:
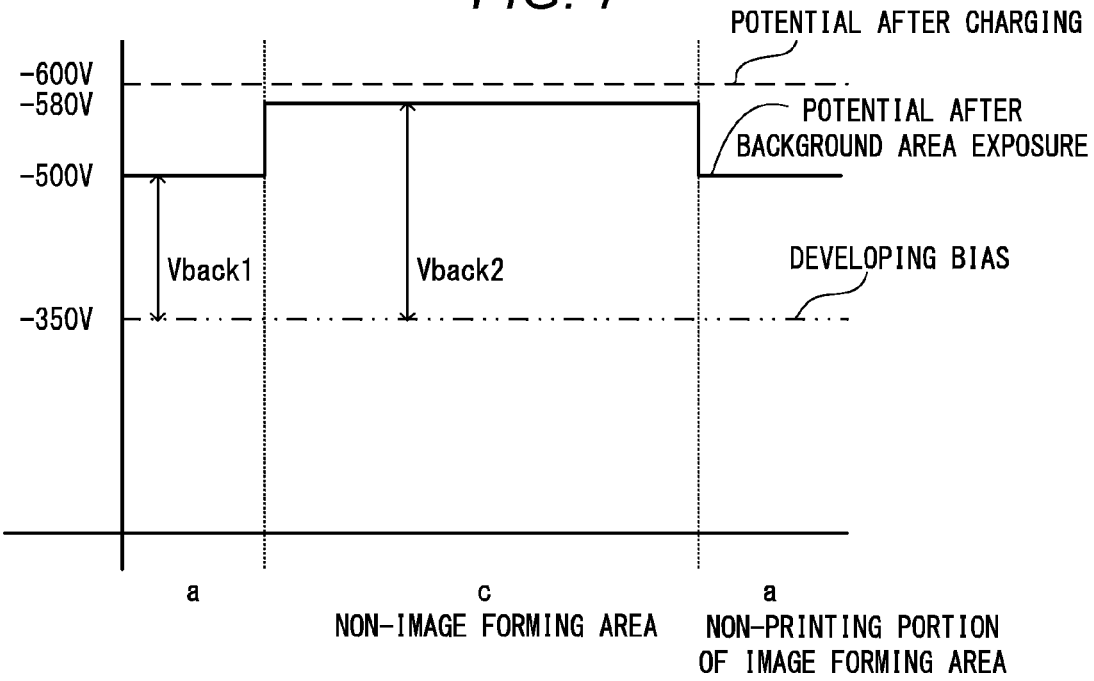
FIG. 7 is a graph showing transitions of photosensitive drum potential which are observed when developing bias is constant.

FIG. 7 shows a relation between the surface potential of the drum 11 and the developing bias in the case where the light amount control described above is performed and developing bias is constant. A portion "a" in FIG. 7 indicates a relation between the drum 11 and the developing bias in the non-printing portions x in the image forming area, and a portion "c" in FIG. 7 indicates a relation between the drum 11 and the developing bias in the non-image forming areas B1 to B3.

The potential of the portion "a" (the non-printing portion in the image forming area) after background area exposure is −500 V, which is dropped from the after-charging potential by 100 V as described above. The potential of the portion "c" (the non-image forming area) after background area exposure to a smaller light intensity than in the portion "a" (the non-printing portion in the image forming area) is −580 V, which is lower by 20 V as described above.

When constant developing bias is applied at −350 V, a back contrast Vback1 of the portion "a" (the non-printing portion in the image forming area) is 150 V and a back contrast Vback2 of the portion "c" (the non-image forming area) is 230 V, which is higher than Vback1 by 80 V.

Figure 8:
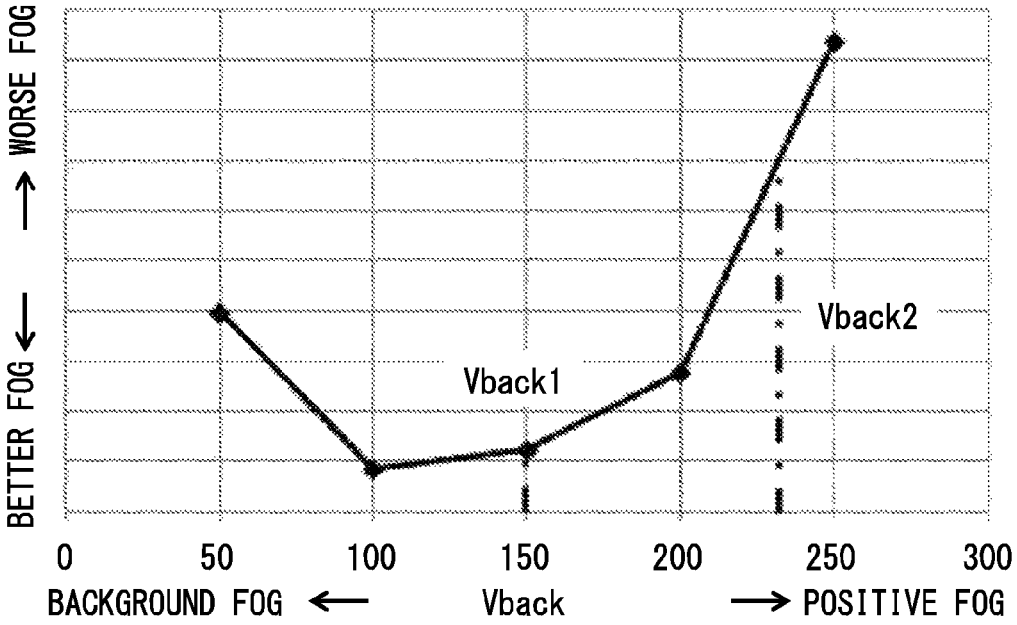
FIG. 8 is a graph showing a relation of fog to back contrast.

FIG. 8 shows a relation between Vback and fog on the drum 11 which has been obtained through a study by the inventors of the present invention. The graph reveals that the portion "c" (the non-image forming area) is increased in positive fog in which toner charged to the opposite polarity (positive charging) is accidentally developed due to toner charging failure or the like. This means not only larger toner consumption than expected but also more toner collected in the cleaner container. An increase in the size of the cleaner container can lead to an increase in the size and cost of the image forming apparatus 1.

<Developing Bias Control>

Figure 9:
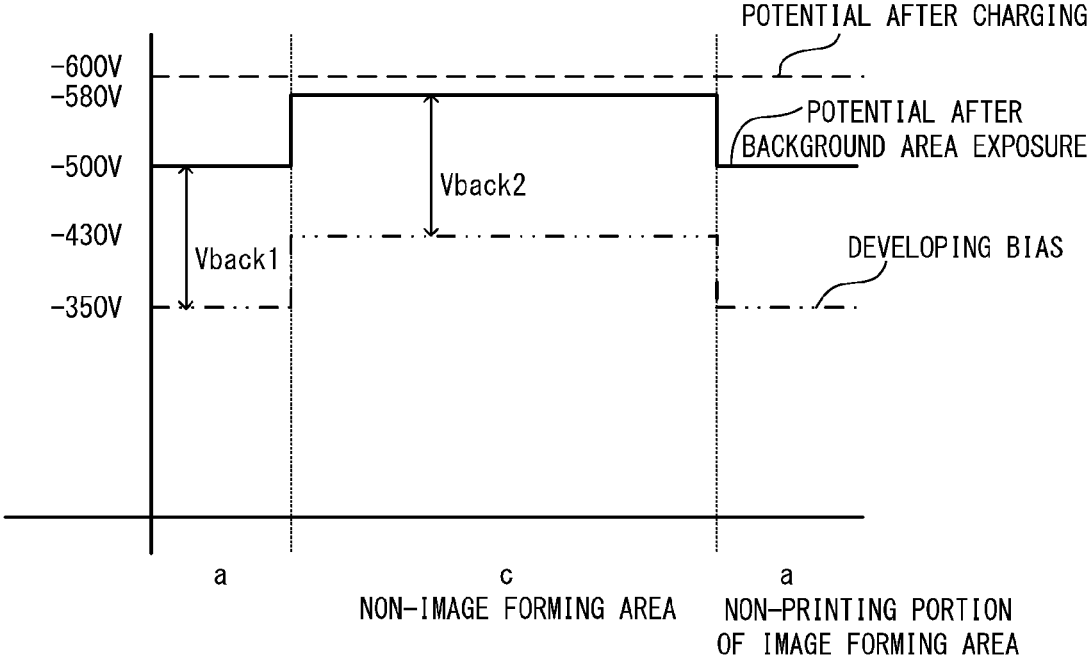
FIG. 9 is a graph showing transitions of photosensitive drum potential which are observed when a developing bias control is performed.

The fog, which results from a difference in back contrast between the non-printing portions x in the image forming area and the non-image forming areas B1 to B3 as described above, is dealt with by performing the following control. As illustrated in FIG. 9, the developing bias in the non-image forming areas is controlled so as to approach the potential on the photosensitive drum 11 after charging, namely, charging bias.

Specifically, developing bias is controlled so that −350 V (a first value) is applied in the portion "a" (the non-printing portion in the image forming area) whereas −430 V (a second value) is applied in the portion "c" (the non-image forming area). This sets Vback1 and Vback2 both to 150 V and the problem of increased positive fog is accordingly avoided. At this time, the portion "a" (the non-printing portion in the image forming area) is exposed at the laser power L2 and the portion "c" (the non-image forming area) is exposed at the laser power L3.

To elaborate, a developing bias of −350 V (the first value) is applied to the developing roller 13 (see FIG. 1) when the developing roller 13 moves into a position which faces the image forming area A1 of the drum 11 (when developing an image) in FIG. 2B. When the developing roller 13 then moves into a position which faces the non-image forming area B2, which is interposed between the image forming areas A1 and A2, the developing bias is changed over to −430 V (the second value). When the developing roller 13 subsequently moves into a position which faces the image forming area A2, the developing bias is changed over to −350 V (the first value).

The amount (L3) of exposure light for the non-image forming area B1 (portion "c") is smaller than the amount (L2) of exposure light for the non-printing portions x (portion "a") of the image forming areas A1 and A2. The potential of the non-image forming area B1 (portion "c") after the exposure of the drum 11 is therefore more on the negative side than the potential of the non-printing portions x of the image forming areas A1 and A2 (portion "a") is.

Accordingly, the potential (developing bias) of the developing roller 13 (see FIG. 1) is controlled so as to approach the potential of the non-image forming area B2 when the developing roller 13 is in a position which faces the non-image forming area B2 (portion "c"). In other words, the value of developing bias is brought close to the value of charging bias (−1,050 V). This is because the potential of the non-image forming area B2 is determined by the value of charging bias (−1,050 V).

The difference between the first value (−350 V) of developing bias and the value (−1,050 V) of charging bias is actually 700 V, and the difference between the second value (−430 V) of developing bias and the value (−1,050 V) of charging bias is 620 V. The difference between the second value and the value of charging bias is thus smaller than the difference between the first value and the value of charging bias.

In this manner, the difference between the potential of the developing roller 13 and the potential of the drum 11 is kept constant even when the potential of the non-image forming area B2 differs from the potential of the non-printing portions x in the image forming areas A1 and A2 after the drum 11 is exposed. Toner which has been carried by the developing roller 13 is prevented from adhering to the non-image forming area B2 (portion "c") as a result.

Developing bias is set to the second value also when the developing roller 13 is in positions which face the non-image forming areas B1 and B3 (see FIG. 2B).

By performing control in this manner, the light intensity used for non-image forming areas and the light intensity to which the photosensitive drum is exposed can be reduced while maintaining quality in terms of drum ghost, transfer memory, fog, and the like. This is effective for a sensitivity decrease due to light-induced fatigue of the photosensitive drum, charge potential attenuation, laser element deterioration, and an increase in the amount of chipping of the photosensitive drum surface which are problems to be overcome in the prolonging of product life.

For example, when an image having a solid white background is printed on two sheets of A4-sized paper in succession as illustrated in FIG. 2B, the non-image forming areas B1 to B3 respectively correspond to three stages, with B1 corresponding to a stage preceding first-sheet image formation (pre-rotation), B2 corresponding to a stage between the first sheet and the second sheet (inter-sheet spacing), and B3 corresponding to a stage following second-sheet image formation (post-rotation).

The laser light emission amount can be reduced to approximately 35% of the amount of laser light emitted in conventional background area exposure where the image forming areas A1 and A2 and the non-image forming areas B1, B2, and B3 are not discriminated from each other and all are exposed under a single light amount setting (i.e., non-image forming areas are exposed to the same light intensity which is used to expose image forming areas).

A resultant effect is a longer laser life prolonged by approximately 60% to 70%. Another effect is the slowing of a decrease in the sensitivity of the drum 11 because the light intensity received by the drum is similarly reduced.

Printing under the condition described above has been repeated to print 5,000 sheets. The sensitivity decrease has been controlled to about 20 V in this printing session by changing over to a smaller background area exposure light amount for the non-image forming areas B1 to B3, whereas the sensitivity decrease is about 30 V when a single light amount setting is used in background area exposure (when non-image forming areas are exposed to the same light intensity which is used to expose image forming areas) as in the conventional method.

The reduction in the light intensity received by the drum 11 has improved the charging potential attenuation as well. An improving trend of approximately 15% has been confirmed for the amount of chipping of the drum 11.

In the present invention, as described above, the light intensity for background area exposure is changed over for the exposure of the non-printing portions x in the image forming areas A1 and A2 and the exposure of the non-image forming areas B1 to B3 so that a small light intensity is used in the background area exposure of the non-image forming areas B1 to B3 which do not need intense background area exposure. This reduces the light intensity received by the drum 11 and reduces the light intensity emitted by the laser element as well. Prolonging photosensitive drum life and laser element life while improving image quality is thus accomplished, and long-term stable image formation is realized as a result.

Background area exposure in the embodiment is performed on the non-image forming areas B1 to B3 as well. However, the background area exposure of the non-image forming areas B1 to B3 may not be executed (laser power L3=0) when the non-image forming areas B1 to B3 do not pose a serious problem in terms of drum ghost without background area exposure.

When the background area exposure of the non-image forming areas B1 to B3 is omitted, further reduction of light-induced fatigue of the drum 11 and further prolonging of laser element life are achieved.

The image forming apparatus 1 of the embodiment is configured so that a toner image is transferred from the drum 11 to the intermediate transfer belt 30 in primary transfer, but the present invention is not limited thereto. The present invention may employ an image forming apparatus configuration in which a toner image is transferred directly from the drum 11 onto the recording material P which is conveyed by the belt 30 serving as a recording material conveying belt, or by another recording material conveying unit.

The present invention is also not limited to the tandem configuration employed by the image forming apparatus 1 of the embodiment in which a plurality of image forming stations are aligned in line. The present invention may employ a single drum-type image forming apparatus configuration in which a plurality of developing units provided for one photosensitive drum are changed over sequentially for development operation.

The configuration of the image forming apparatus 1 of the first embodiment, by which the effects described above are obtained, is summarized as follows.

The image forming apparatus 1 includes a photosensitive member 11 and a charging unit 12 configured to charge the surface of the photosensitive member 11 to a predetermined electric potential. An exposure unit 20 is also included which exposes the photosensitive member 11 charged by the charging unit 12 to light. The exposure unit 20 performs exposure at the first laser power L1 to obtain the potential of the printing portions y in the image forming areas A, performs exposure at the second laser power L2 to obtain the potential of the non-printing portions x in the image forming areas A, and performs exposure at the third laser power L3 to obtain the potential of the non-image forming areas B. The image forming apparatus 1 also includes a developing unit 13 configured to form a developer image by making the developer adhere to the printing portions y, and a control unit (control portion) 100 configured to control developing bias which is supplied to the developing unit 13.

The first laser power, the second laser power, and the third laser power satisfy a relation L1>L2>L3. The control unit 100 controls the developing bias which is supplied to the developing unit 13 when no image is formed so as to approach charging bias supplied to the charging unit 12, relative to the developing bias which is supplied to the developing unit 13 when an image is formed.

Second Embodiment

The image forming apparatus configuration, the image forming process, and the image forming area exposure control in a second embodiment are the same as those in the first embodiment. The second embodiment has a feature of using background area exposure control to deal with problems which can arise from change in a rising edge and a falling edge caused when the developing bias is changed over by the developing bias control.

<Possible Problems Arising at Changeover of Developing Bias>

In the first embodiment, background area exposure control and developing bias control are performed concurrently when the transition from a non-printing portion in an image forming area to a non-image forming area takes place.

In exposure control, the light intensity is changed over relatively quickly and the surface potential of the drum 11 therefore is changed over instantly as well. However, when changing over developing bias, the transition between a rising edge and a falling edge is slower than the changeover in exposure control in some cases due to the characteristics of a high-voltage power supply.

Figure 10:
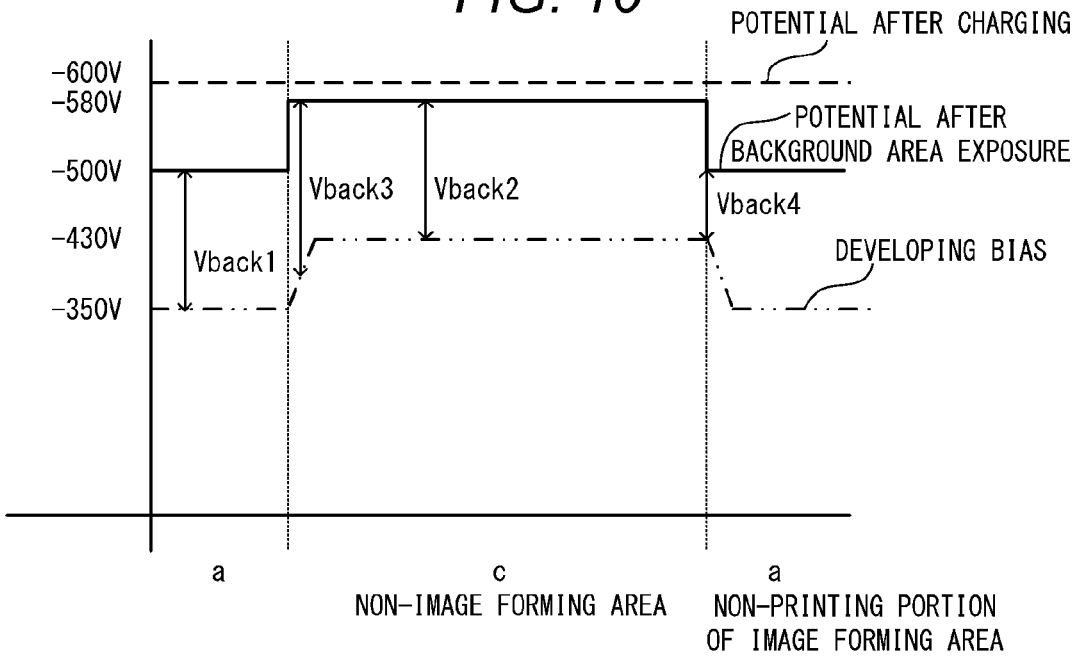
FIG. 10 is a graph showing transitions of photosensitive drum potential which are observed when there is a variation curve at the time when a developing bias is changed over in a second embodiment.

When this occurs, the surface potential of the drum 11 and developing bias have a relation shown in FIG. 10 at the time the light intensity of the background area exposure and the developing bias are changed over simultaneously as in the first embodiment. Developing bias is changed over from −350 V to −430 V when the transition from a non-printing portion in an image forming area, which corresponds to a portion "a" in FIG. 10, to a non-image forming area, which corresponds to a portion "c" in FIG. 10, takes place, and a rise period (rise time) begins at this point. The rise period may therefore contain a period in which a back contrast Vback3 higher than Vback1 or Vback2 is observed.

In this period, a positive fog occurs as described above but is temporary and confined to the rise period. The amount of toner collected in the cleaner container is therefore small, and the fog does not lead to an increase in the size and cost of the image forming apparatus 1 which is due to the increased size of the cleaner container.

Developing bias is changed over from −430 V (the second value) to −350 V (the first value) when the transition from a non-image forming area of the portion "c" in FIG. 10 to a non-printing portion of the portion "a" in an image forming area in FIG. 10 takes place, and a fall period (fall time) begins at this point. In other words, developing bias changes from the second value to the first value in stages. The fall period may therefore contain a period in which a back contrast Vback4 lower than Vback1 or Vback2 is observed.

In this period, a background fog where normally charged (negatively charged) toner adhere to the drum 11 increases as shown in FIG. 8. Background fog toner developed on the drum 11 which is mainly negatively charged toner is transferred onto the belt 30 and then contaminates the secondary transfer roller 32. There is a chance that the back of the recording material P is stained by the contaminated secondary transfer roller 32.

<Background Area Exposure Control>

Figure 11:
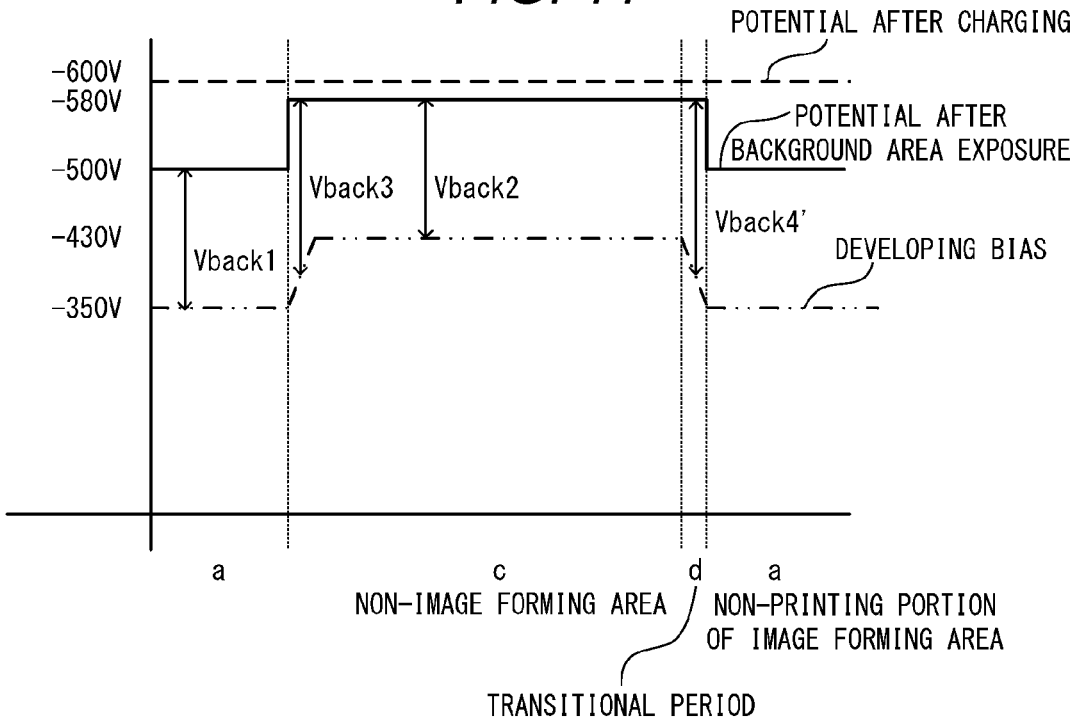
FIG. 11 is a graph showing transitions of photosensitive drum potential which are observed when background area exposure is controlled while taking into account the variation curve at the changeover of developing bias in the second embodiment of the present invention.

The background fog which is generated in the fall period of developing bias as described above is dealt with by providing, as shown in FIG. 11, a transition period (a portion "d" in FIG. 11) in which developing bias is allowed to drop satisfactorily while the transition from a non-image forming area of a portion "c" in FIG. 11 to a non-printing portion of a portion "a" in an image forming area in FIG. 11 progresses.

The light intensity for background area exposure in the transition period of the portion "d" in FIG. 11 is set to an amount equivalent to the amount of exposure light for the non-image forming area of the portion "c". A back contrast Vback4' in this period is similar to Vback3, and thus a temporary background fog which does not pose a serious problem as described above is generated.

Exerting control in this manner yields the following effect. Specifically, unlike the first embodiment, reducing the light intensity which is used for the exposure of a non-image forming area and the light intensity which is received by the photosensitive drum while maintaining quality in terms of drum ghost, transfer memory, fog, and the like is accomplished also in cases where the transition between a rising edge and a falling edge is slow at the time developing bias is changed over.

The configuration of the image forming apparatus 1 of the second embodiment, by which the effects described above are obtained, is summarized as follows. In a transition period where the transition from non-image formation to image formation takes place, after the transition from developing bias which is supplied in non-image formation to developing bias which is supplied in image formation is completed, the control unit 100 controls the developing unit 13 and the exposure unit 20 so that the transition from the third laser power L3 for exposure in non-image formation to the first laser power L1, or the second laser power L2, for exposure in image formation is started.

Referring to FIG. 2B, the configuration of the embodiment is rephrased as follows. When the developing roller 13 (see FIG. 1) is changed over from a position which faces the non-image forming area B2 (an area exposed at the laser power L3, or an area exposed at no laser power) to a position which faces the image forming area A1 (an area exposed at the laser power L2 and the laser power L1), the control unit 100 changes developing bias from the second value (−430 V) to the first value (−350 V) while the developing roller 13 is in the position which faces the non-image forming area B2.

Third Embodiment

The image forming apparatus configuration, the image forming process, and the image forming area exposure control in a third embodiment are the same as those in the first embodiment. In addition, the second embodiment has described that, when a change in a rising edge and a falling edge which are caused when the developing bias is changed over by the developing bias control occurs, there is a chance that a positive fog may occur in the rise period and a background fog may occur in the fall period.

Figure 12:
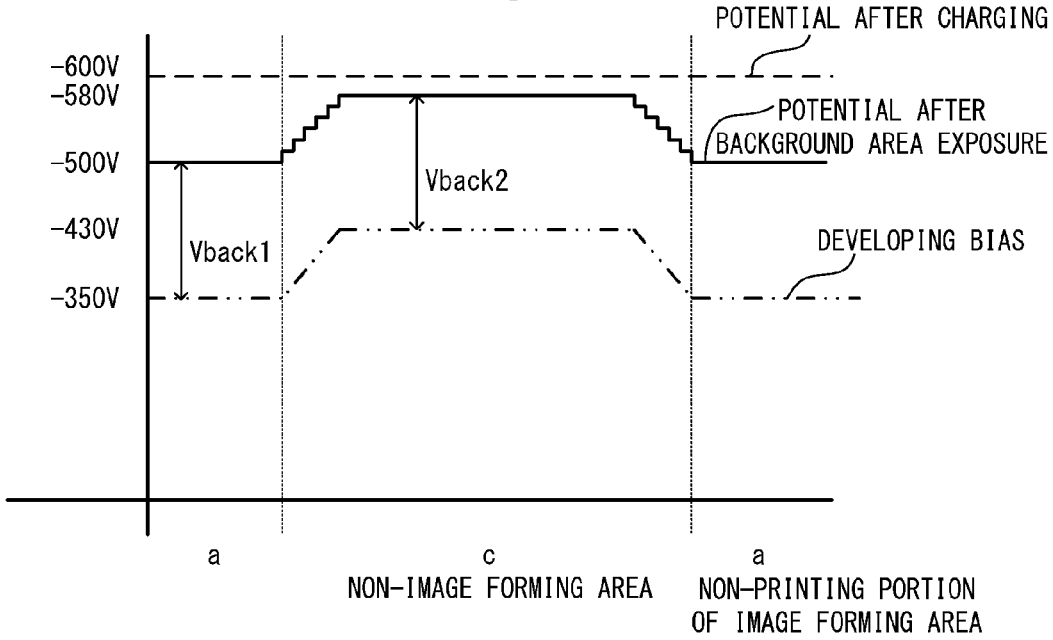
FIG. 12 is a graph showing transitions of photosensitive drum potential which are observed when background area exposure is controlled so as to deal with a variation curve at the changeover of developing bias in a third embodiment.

The third embodiment describes a background area exposure control which is performed when the variation curve of developing bias is known in advance. Background area exposure is controlled so that the amount of exposure light is changed over in stages in keeping with the rising edge-falling edge variation curve of developing bias in a non-image forming area of a portion "c" as shown in FIG. 12. This way, back contrast is controlled so as to generally stay Vback2 while the amount of background area exposure light is changed over in stages.

In other words, a changeover to a predetermined laser power level is executed by varying the laser power of the exposure unit 20 in stages in keeping with a bias variation curve which is observed when developing bias is changed over by the control unit 100.

Reducing the light intensity which is used for the exposure of a non-image forming area and the light intensity which is received by the photosensitive drum while maintaining quality in terms of drum ghost, transfer memory, fog, and the like is thus accomplished without encountering the positive fog, the background fog, and other problems described in the second embodiment.

Referring to FIG. 2B, the configuration of the embodiment is rephrased as follows. When the developing roller 13 (see FIG. 1) is changed over from a position which faces the image forming area A1 to a position which faces the non-image forming area B2, the developing bias is changed from the first value to the second value in stages. During the change, the exposure unit 20 (see FIG. 1) which is exposing the non-printing portion x of the image forming area A1 at the second laser power decreases laser power in stages until the third laser power is reached (or stops exposure).

When the developing roller 13 is changed over from a position which faces the non-image forming area B2 to a position which faces the image forming area A2, the developing bias changes back from the second value to the first value in stages. To match with this variation curve of developing bias, the exposure unit 20 (see FIG. 1) which is exposing the non-image forming area B2 at the third laser power (or, is not exposing the non-image forming area B2 to any light) increases laser power in stages until the second laser power is reached.

Fourth Embodiment

The image forming apparatus configuration, the image forming process, the image forming area exposure control, and the background area exposure control in a fourth embodiment are the same as those in the first embodiment. In the embodiment, instead of controlling the developing bias, the charging bias is controlled.

Figure 13:
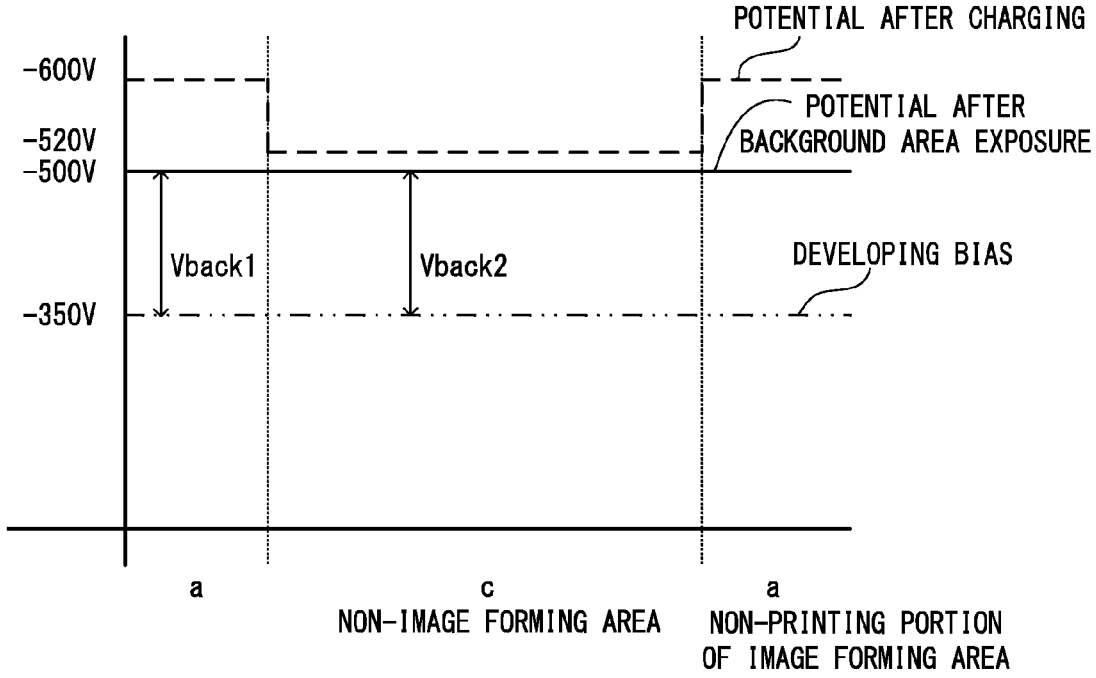
FIG. 13 is a graph showing transitions of photosensitive drum potential which are observed when a charging bias control according to a fourth embodiment is performed.

Specifically, the charging bias which is applied to a non-image forming area of a portion "c" in FIG. 13 is controlled so as to approach the developing bias, relative to the charging bias which is applied to a non-printing portion of a portion "a" in an image forming area in FIG. 13. In other words, when the charging roller 12 (FIG. 1) charges the non-image forming areas B1 to B3 (see FIG. 2B) of the drum 11, the charging bias is set to a value lower than when the charging roller 12 charges the image forming areas A1 and A2 of the photosensitive drum 11 (is changed toward the positive side).

Charging bias at which the charging roller 12 charges the image forming area A1 of the drum 11 in FIG. 2B is specifically −1,050 V (a first value). Charging bias at which the charging roller 12 charges the non-image forming area B2 is −970 V (a second value). Charging bias returns to −1,050 V (the first value) when the charging roller 12 subsequently charges the image forming area A2.

Charging bias is set to −970 V (the second value) also when the charging roller 12 charges the non-image forming areas B1 and B2.

In short, the value of charging bias approaches the value of developing bias (−350 V) when the charging roller 12 charges the non-image forming areas B1 to B3. In other words, the difference between the second value of charging bias and the value of developing bias (620 V) becomes smaller than the difference between the first value of charging bias and the value of developing bias (700 V).

Through this control, combined with the background area exposure control described in the first embodiment, the potential on the drum 11 after background area exposure is controlled so that the back contrast in a non-printing portion of the portion "a" in an image forming area is equal to the back contrast in a non-image forming area of the portion "c". The light intensity used and the amount of exposure light received by the photosensitive drum is thus reduced while reducing positive fog in the non-image forming area.

Background area exposure in the embodiment is performed on non-image forming areas as well. However, the background area exposure of non-image forming areas may not be executed (laser power L3=0) when the non-image forming areas do not pose a serious problem in the resultant image without background area exposure.

When the background area exposure of non-image forming areas is omitted, further reduction in light-induced fatigue of the photosensitive drum and further prolonging of laser element life are achieved.

The embodiment has described a configuration in which background area exposure control and charging bias control are performed concurrently in the transition from a non-printing portion in an image forming area to a non-image forming area. However, the present invention can employ any configuration in which an absolute value of the difference between the potential on the drum 11 after background area exposure and the developing bias is not narrower than the background contrast Vback1 of the portion "a" in FIG. 13 so that background fog does not occur in the case where change in a rising edge and a falling edge is observed in the variation curve at the time charging bias is changed over. Background area control may be executed after a transition period is provided as in the second embodiment. In the case where the variation curve is known in advance as in the third embodiment, background area exposure control may be changed over in stages in keeping with the variation curve.

The configuration of the image forming apparatus 1 of the fourth embodiment, by which the effects described above are obtained, is summarized as follows.

The image forming apparatus 1 includes a photosensitive member 11 and a charging unit 12 configured to charge the surface of the photosensitive member 11 to a predetermined electric potential. An exposure unit 20 is also included which exposes the photosensitive member 11 charged by the charging unit 12 to light. The exposure unit 20 performs exposure at the first laser power L1 to obtain the potential of printing portions y of image forming areas A, performs exposure at the second laser power L2 to obtain the potential of non-printing portions x of the image forming areas A, and performs exposure at the third laser power L3 to obtain the potential of non-image forming areas B. The image forming apparatus 1 also includes a developing unit 13 configured to form a developer image by making developer adhere to the printing portions y, and a control unit 100 configured to control charging bias which is supplied to the charging unit 12.

The first laser power, the second laser power, and the third laser power satisfy a relation L1>L2>L3. The control unit 100 controls charging bias which is supplied to the charging unit 12 when no image is formed so as to approach developing bias supplied to the developing unit 13, relative to charging bias which is supplied to the charging unit 12 when an image is formed.

The configurations of developing bias control described in the second embodiment and the third embodiment are applicable to the charging bias control of the embodiment. The concept of the developing bias control of the second embodiment is applied to the charging bias control of the embodiment as follows.

In a transition period where the transition from non-image formation to image formation takes place, after the transition from charging bias which is supplied in non-image formation to charging bias which is supplied to the charging unit 12 in image formation is completed, the control unit 100 controls the charging unit 12 and the exposure unit 20 so that the transition from the third laser power L3 for exposure in non-image formation to the first laser power L1, or the second laser power L2, for exposure in image formation is started.

The charging bias control is further summarized with reference to FIG. 2B as follows. When the charging roller 12 is changed over from the charging of the non-image forming area B2 to the charging of the image forming area A2, the control unit 100 changes the charging bias from the second value (−970 V) to the first value (−1,050 V) while the charging roller 12 is charging the non-image forming area B2.

The control of the third embodiment is applied to the embodiment as follows. Specifically, a changeover to a predetermined laser power level is executed by varying the laser power of the exposure unit 20 in stages to suit the surface potential of the photosensitive member 11 charged in keeping with a bias variation curve which represents changes observed when the control unit 100 changes over the charging bias.

This control is further summarized with reference to FIG. 2B as follows. When the charging roller 12 (see FIG. 1) is changed over from the charging of the image forming area A1 to the charging of the non-image forming area B2, the charging bias changes from the first value to the second value in stages. To match with this variation curve of charging bias, the exposure unit 20 (see FIG. 1) which is exposing the non-printing portion x of the image forming area A1 at the second laser power decreases laser power in stages until the third laser power is reached (or stops exposure).

When the charging roller 12 is changed over from the charging of the non-image forming area B2 to the charging of the image forming area A2, the charging bias changes from the second value to the first value in stages. To match with this variation curve of charging bias, the exposure unit 20 (see FIG. 1) which is exposing the non-image forming area at the third laser power (or, is not exposing the non-image forming area to any light) may increase laser power in stages until the second laser power is reached.

Lastly, the effects of the image forming apparatus of the first to fourth embodiments are summarized as follows. Specifically, the image forming apparatus of each embodiment is capable of reducing the amount of exposure light which is received by the photosensitive member while maintaining image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-279047, filed on Dec. 21, 2012, which is hereby incorporated by reference herein in its entirety.

What is claimed is:

1. An image forming apparatus configured to form an image on a recording material, the image forming apparatus comprising:

a photosensitive member;

a charging device configured to charge the photosensitive member by a charging bias being applied to the charging device;

an exposure device configured to expose the photosensitive member, which has been charged by the charging device, to light to form a latent image on the photosensitive member;

a developer carrying member which carries a developer and which is configured to develop the latent image with the developer by a developing bias being applied to the developer carrying member; and a control portion configured to control the developing bias, wherein, when an image forming area is defined as an area on the photosensitive member on which an image to be transferred onto a recording material is formed, a printing portion is defined as an area in the image forming area to which the developer carrying member makes the developer adhere, a non-printing portion is defined as an area in the image forming area to which the developer carrying member does not make the developer adhere, and a non-image forming area is defined as an area on the photosensitive member disposed between two adjacent image forming areas in a moving direction of a surface of the photosensitive member, the exposure device exposes the printing portion in the image forming area at a first laser power, exposes the non-printing portion in the image forming area at a second laser power smaller than the first laser power, and exposes the non-image forming area at no laser power or a third laser power smaller than the second laser power, and wherein said control portion sets the developing bias to a first value when the developer carrying member is in a position which faces the image forming area, sets the developing bias to a second value when the developer carrying member is in a position which faces the non-image forming area, and sets the first value and the second value so that a difference between the second value and a value of the charging bias is smaller than a difference between the first value and the value of the charging bias.

2. An image forming apparatus according to claim 1, wherein, when a state in which the developer carrying member faces the non-image forming area is to be changed over to a state in which the developer carrying member faces the image forming area, the control portion changes the developing bias from the second value to the first value while the developer carrying member faces the non-image forming area.

3. An image forming apparatus according to claim 1, wherein, when a state in which the developer carrying member faces the non-image forming area is changed over to a state in which the developer carrying member faces the image forming area, the developing bias is changed from the second value to the first value in stages, and a state in which the exposure device exposes the non-image forming area at no laser power or the third laser power is changed over to a state in which the exposure device increases a laser power to the second laser power in stages.

4. An image forming apparatus according to claim 1, wherein, when a state in which the developer carrying member faces the image forming area is changed over to a state in which the developer carrying member faces the non-image forming area, the developing bias is changed from the first value to the second value in stages, and a state in which the exposure device exposes the non-printing portion in the image forming area at the second laser power is changed over to a state in which the exposure device decreases a laser power to the third laser power in stages or decreases the laser power in stages to stop exposing.

5. An image forming apparatus configured to form an image on a recording material, the image forming apparatus comprising:

a photosensitive member;

a charging device configured to charge the photosensitive member by a charging bias being applied to the charging device;

an exposure device configured to expose the photosensitive member, which has been charged by the charging device, to light to form a latent image on the photosensitive member;

a developer carrying member which carries a developer and which is configured to develop the latent image with the developer by a developing bias being applied to the developer carrying member; and a control portion configured to control the charging bias, wherein, when an image forming area is defined as an area on the photosensitive member on which an image to be transferred onto a recording material is formed, a printing portion is defined as an area in the image forming area to which the developer carrying member makes the developer adhere, a non-printing portion is defined as an area in the image forming area to which the developer carrying member does not make the developer adhere, and a non-image forming area is defined as an area on the photosensitive member disposed between two adjacent image forming areas in a moving direction of a surface of the photosensitive member, the exposure device exposes the printing portion in the image forming area at a first laser power, exposes the non-printing portion in the image forming area at a second laser power smaller than the first laser power, and exposes the non-image forming area at no laser power or a third laser power smaller than the second laser power, and wherein said control portion sets the charging bias to a first value when the charging device charges the image forming area, sets the charging bias to a second value when the charging device charges the non-image forming area, and sets the first value and the second value so that a difference between the second value and a value of the developing bias is smaller than a difference between the first value and the value of the developing bias.

6. An image forming apparatus according to claim 5, wherein, when a state in which the charging device charges the non-image forming area is to be changed over to a state in which the charging device charges the image forming area, the control portion changes the charging bias from the second value to the first value while the charging device charges the non-image forming area.

7. An image forming apparatus according to claim 5, wherein, when a state in which the charging device charges the non-image forming area is changed over to a state in which the charging device charges the image forming area, the charging bias is changed from the second value to the first value in stages, and a state in which the exposure device exposes the non-image forming area at no laser power or the third laser power is changed over to a state in which the exposure device increases a laser power to the second laser power in stages.

8. An image forming apparatus according to claim 5, wherein, when a state in which the charging device charges the image forming area is changed over to a state in which the charging device charges the non-image forming area, the charging bias is changed from the first value to the second value in stages, and a state in which the exposure device exposes the non-printing portion in the image forming area at the second laser power is changed over to a state in which the exposure device decreases a laser power to the third laser power in stages or decreases the laser power in stages to stop exposure.

* * * * *